US008336976B2

(12) United States Patent
Lee

(10) Patent No.: US 8,336,976 B2
(45) Date of Patent: Dec. 25, 2012

(54) KEEPING DEVICE FOR REFRIGERATOR AND REFRIGERATOR HAVING THE SAME

(75) Inventor: Jong-Hwa Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 255 days.

(21) Appl. No.: 12/765,038

(22) Filed: Apr. 22, 2010

(65) Prior Publication Data

US 2010/0283368 A1 Nov. 11, 2010

(30) Foreign Application Priority Data

May 8, 2009 (KR) ..... 10-2009-0040376

(51) Int. Cl.
*A47B 96/04* (2006.01)

(52) U.S. Cl. ..... 312/405.1; 312/408

(58) Field of Classification Search ..... 312/404, 312/405, 405.1, 312.5, 408; 62/449, 440, 62/337

See application file for complete search history.

(56) References Cited

U.S. PATENT DOCUMENTS 2,042,517 A * 6/1936 Ellis ..... 108/135
2,062,360 A * 12/1936 Goulooze ..... 312/275
2,287,611 A * 6/1942 Harbison ..... 312/313
2,517,385 A * 8/1950 Clark ..... 312/323
3,625,371 A * 12/1971 Dill ..... 211/153
5,813,741 A * 9/1998 Fish et al. ..... 312/408
6,584,916 B1 * 7/2003 Felton et al. ..... 108/107
2008/0034778 A1 * 2/2008 Lim et al. ..... 62/340
2009/0033191 A1 * 2/2009 Kim ..... 312/405.1
2010/0109498 A1 * 5/2010 Ramm et al. ..... 312/408
2010/0253197 A1 * 10/2010 Jung ..... 312/408
2011/0001415 A1 * 1/2011 Park et al. ..... 312/408

FOREIGN PATENT DOCUMENTS

DE 19646206 A1 * 5/1998

* cited by examiner

*Primary Examiner* — Hanh V Tran
(74) *Attorney, Agent, or Firm* — Fish & Richardson P.C.

(57) ABSTRACT

In a keeping device for a refrigerator, a moving shelf is installed to adjust the space between door baskets according to the height of food items received in the door baskets. When the moving shelf is folded, a long food item can be stably received, and when the folded moving shelf is unfolded, the receiving space can be extended to receive more food items. Also, because moving support portions supporting the moving shelf are provided at both sides, collision noise can be reduced when the moving shelf is unfolded, and because a restraining unit is provided between the moving shelf and the door, the folded state of the moving shelf can be stably maintained. In addition, because the keeping device is hung and fixed such that it is tightly attached to the door, the keeping space can be extended.

16 Claims, 11 Drawing Sheets

KEEPING DEVICE FOR REFRIGERATOR AND REFRIGERATOR HAVING THE SAME

The present application claims priority to Korean Application No. 10-2009-0040376 filed in Korea on May 8, 2009, the entire contents of which is hereby incorporated by reference in its entirety.

BACKGROUND OF THE INVENTION

1. Field of the Invention

The present invention relates to a keeping device for a refrigerator and, more particularly, to a keeping device for a refrigerator having a large keeping space by including a movable shelf that can be folded and unfolded and a refrigerator having the same.

2. Description of the Related Art

In general, a refrigerator is a device having a certain accommodating space to keep food items, or the like, in a low temperature state. Discriminating low temperature ranges for freezing or refrigerating food items depending on the state of food items to be kept in storage, the refrigerator is divided into a refrigerating chamber for keeping food items in storage in an above-zero degree and a freezing chamber for keeping food items in storage in a below-zero degree. The interior of the refrigerator is cooled by continuously supplied cooling air, and cooling air is continuously generated by a heat exchanging operation of a refrigerant which repeatedly performs the cycle of compressing, condensing, expanding, and evaporating.

The refrigerator includes a type in which the freezing chamber is positioned at an upper side of the refrigerating chamber, a type in which the freezing chamber is positioned at a lower side of the refrigerating chamber, and a type in which the freezing chamber and the refrigerating chamber are positioned to be adjacent horizontally. Recently, a large-capacity refrigerator or a multi-functional refrigerator tends to be on demand in line with the diversification of user preferences and a change in the people's dietary life, for to which refrigerators in various structures are released.

Each internal space of the freezing chamber and refrigerating chamber form various storage spaces by a plurality of shelves and drawers. A freezing chamber door and a refrigerating chamber door are installed at a front side of each of the freezing chamber and the refrigerating chamber in order to selectively open and close the freezing chamber and the refrigerating chamber.

A plurality of door baskets are provided in layers with a certain height difference at an inner surface of the freezing chamber door and the refrigerating chamber door in order to keep food items such as drinking water bottles, cans, or the like, which are kept largely in a standing position, in storage. Here, the space between the door baskets is larger than the height of the drinking water bottles, cans, or the like, accommodated in the door baskets.

In the related art refrigerator, when the drinking water bottles, cans, or the like, are received in the door baskets, the space between the door baskets are preferably large. However, in an otherwise case, namely, when shorter items are accommodated, the space between the door baskets is too large to utilize. Thus, in consideration of this, a method of including a cover for performing selectively opening and closing operation at the door baskets of the related art refrigerator to enlarge the receiving space has been proposed.

However, the related art refrigerator having the cover is disadvantageous in that because the cover closes the door basket, when an item is received in the door basket or when an item received in the door basket is taken out, the item should be first drawn out of the cover, the cover is open, and the item is received in the door basket or the received item should be taken.

Also, in the related art refrigerator having the cover has a problem in that because the cover is tightly attached to the door basket, when the cover is folded or unfolded, collision noise can increase. In addition, the structure for restraining the cover when the cover is folded is complicated to increase the fabrication cost.

In addition, in the related art refrigerator, fixed support portions are protrusively formed at both sides of the outer surface of the door basket and corresponding sides of the inner surface of the door, which are to be engaged to be coupled. In this case, however, a portion of the door basket is inwardly bent by the height of the fixed support portions, reducing a valid space.

SUMMARY OF THE INVENTION

Therefore, in order to address the above matters, the various features described herein have been conceived.

An aspect of the present invention provides a keeping device for a refrigerator allowing a food item to be easily received in a door basket or a food item received in the door basket to be easily taken out, and a refrigerating having the same.

Another aspect of the present invention provides a keeping device for a refrigerator capable of simplifying the structure of a door basket to reduce a fabrication unit, and a refrigerator having the same.

Still another aspect of the present invention provides a keeping device for a refrigerator capable of being easily and stably enlarged, and a refrigerator having the same.

According to an aspect of the present invention, there is provided a to refrigerator including: a door for opening and closing a freezing chamber or a refrigerating chamber; a moving shelf rotatably installed at the door; a support unit maintaining a first state for allowing the moving shelf to receive a food item; and a restraining unit provided between the moving shelf and the door and maintaining a second state in which the moving shelf does not support the food item, wherein the support unit includes a fixed support portion formed at the door and a moving support portion formed with a certain height on a lower surface of the moving shelf and supported by the fixed support portion.

According to another aspect of the present invention, there is provided a keeping device for a refrigerator including: a frame detachably coupled to a door for opening and closing a freezing chamber or a refrigerating chamber; one or more door baskets fixed coupled to the frame; a moving shelf positioned at an upper side of the door basket and rotatably coupled to the frame; a support unit maintaining in a first state in which the moving shelf receives a food item; and a restraining unit provided between the moving shelf and the frame and maintaining a state in which the moving shelf does not support a food item, wherein the support unit includes a fixed support portion formed at the frame and a moving support portion formed with a certain height on a lower surface of the moving shelf and supported by the fixed support portion.

The foregoing and other objects, features, aspects and advantages of the present invention will become more apparent from the following detailed description of the present invention when taken in conjunction with the accompanying drawings.

DETAILED DESCRIPTION OF THE INVENTION

A keeping device for a refrigerator and a refrigerator having the same according to exemplary embodiments of the present invention will now be described with reference to the accompanying drawings.

Figure 1:
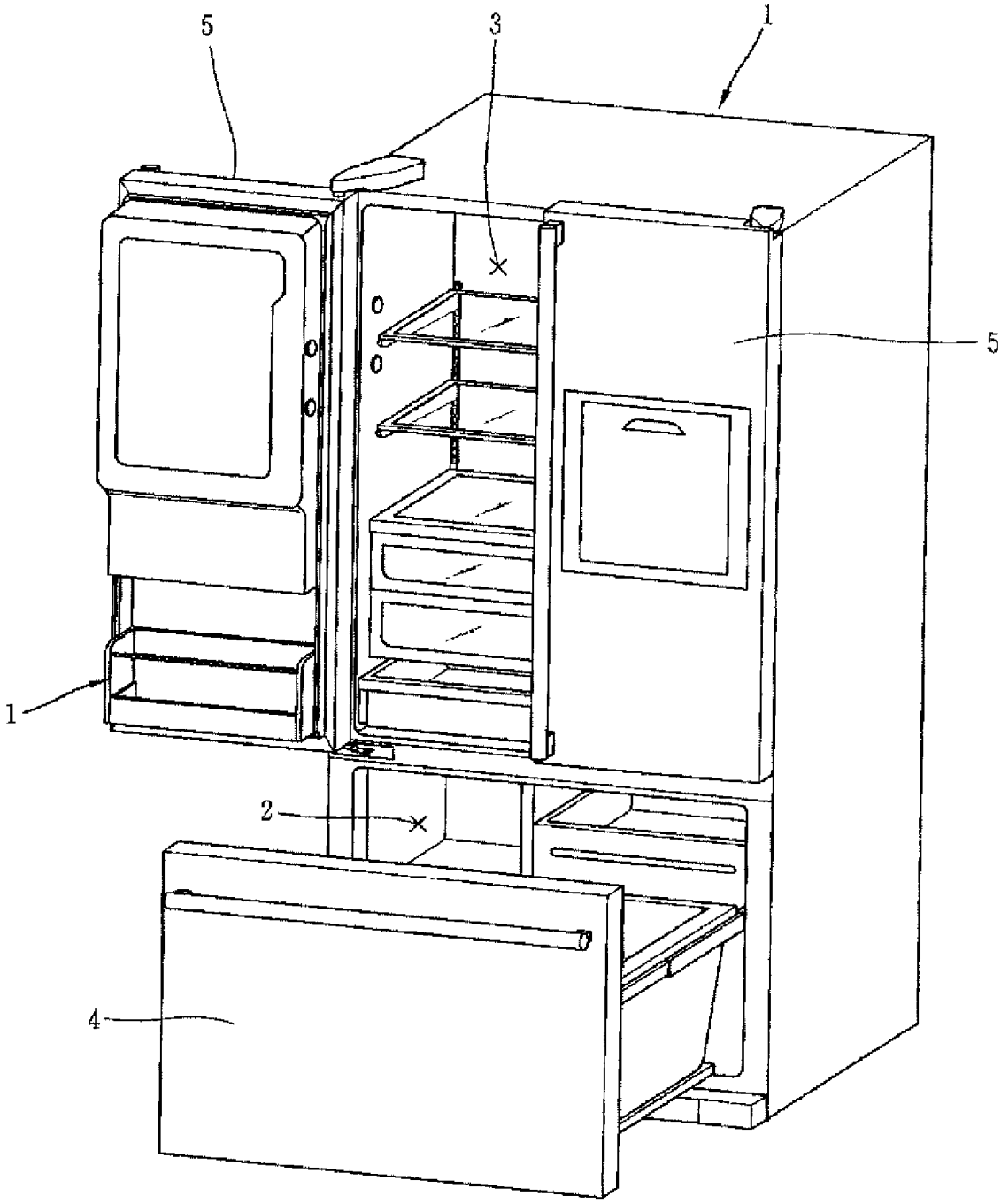
FIG. 1 is a perspective view showing a bottom freezer type refrigerator having a door basket according to an exemplary embodiment of the present invention.

FIG. 1 is a perspective view showing a bottom freezer type refrigerator having a door basket according to an exemplary embodiment of the present invention.

As shown in FIG. 1, the refrigerator according to an exemplary embodiment of the present invention includes a freezing chamber 2 formed at a lower portion of a refrigerator body 1 and keeping food items in storage in a frozen state and a refrigerating chamber 3 formed at an upper portion of the refrigerator body 1 and keeping food items in storage in a refrigerated state. The freezing chamber 2 includes a freezing chamber door 4 to open and close the freezing chamber 2 in a drawer manner, and a plurality of refrigerating chamber doors 5 are installed at the refrigerating chamber 3 to open and close the refrigerating chamber 3 at both sides in a hinged manner.

A mechanic chamber (not shown) is formed at a lower end of a rear side of the refrigerator body 1, in which a compressor and a condenser are installed. An evaporator (not shown) connected with the condenser and the compressor to supply cooling air to the freezing chamber 2 or to the refrigerating chamber 3 is generally installed on the rear surface of the refrigerator body 1, namely, on the rear wall surface of the freezing chamber. However, the present invention is not limited thereto and the evaporator may be insertedly positioned at an inner side of a wall surface or an upper wall surface of the freezing chamber 2 or may be insertedly positioned at an inner to side of a barrier demarcating the freezing chamber 2 and the refrigerating chamber 3. A single evaporator may be installed at the freezing chamber 2 to distributedly supply cooling air to the freezing chamber 2 and to the refrigerating chamber. Alternatively, a freezing chamber evaporator and a refrigerating chamber evaporator may be installed separately in order to independently supply cooling air to the freezing chamber 2 and to the refrigerating chamber 3.

FIGS. 2 to 7 illustrate a keeping device for the refrigerator of FIG. 1.

Figure 2:
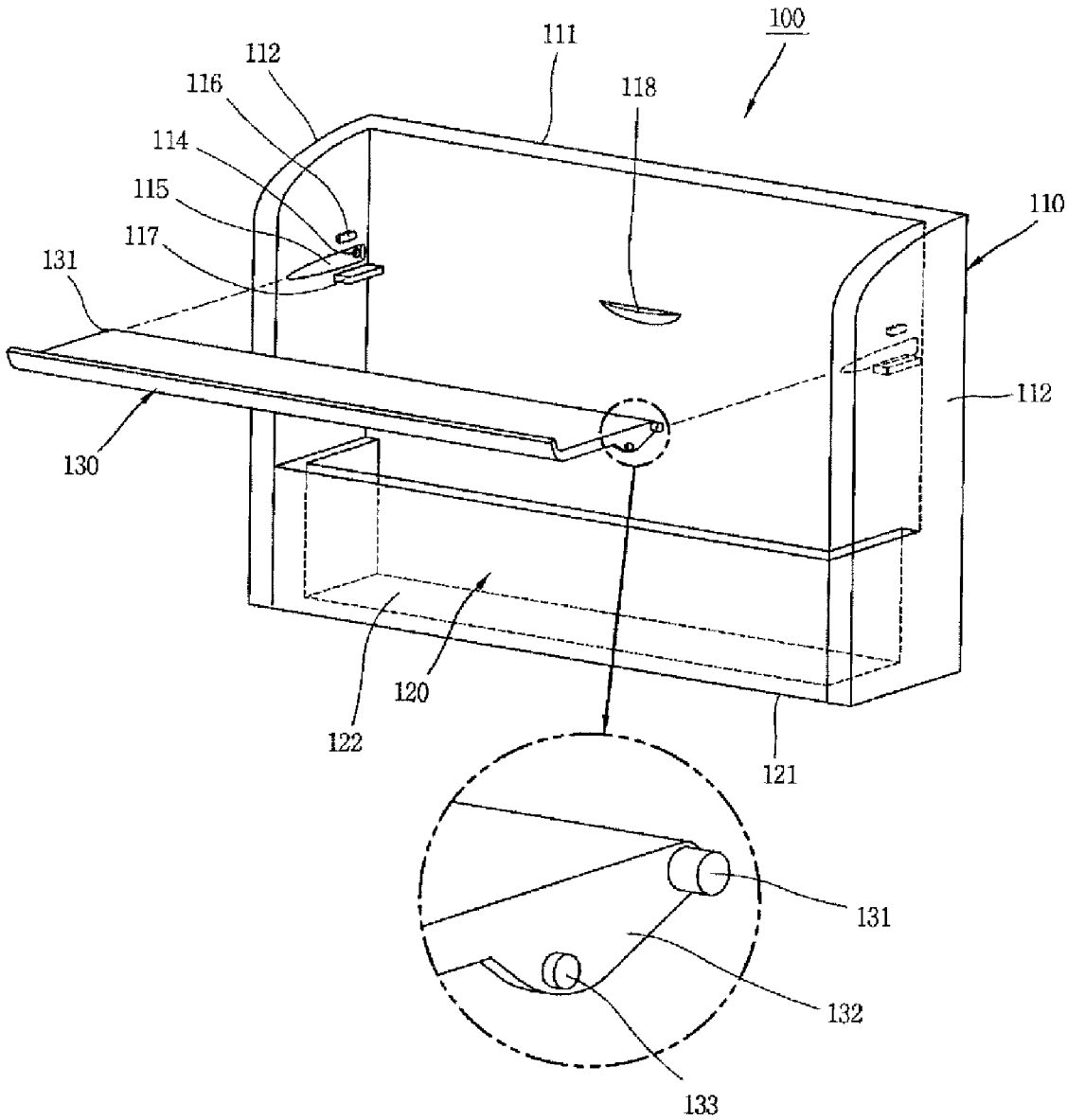
FIG. 2 is a front perspective view showing a moving shelf separated from a keeping device of the refrigerator in FIG. 1.

As shown in FIG. 2, a keeping device 100 is installed on an inner wall surface of the refrigerating chamber door 5, allowing a large amount of lengthy food items such as a drinking water bottle or a shorter food item such as a can to be received therein.

The keeping device 100 includes a frame 110 detachably coupled to the refrigerating chamber door 5, and a door basket 120 and a moving shelf 130 installed along a heightwise direction of the frame 110.

Figure 3:
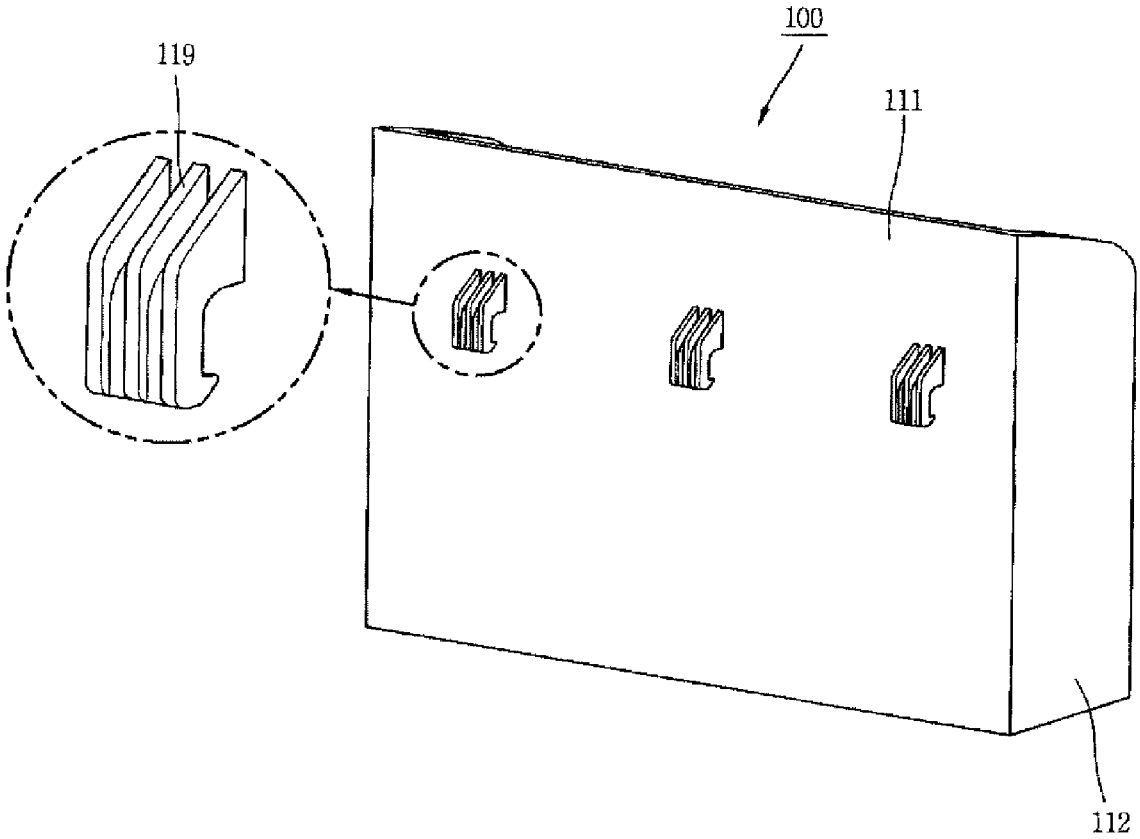
FIG. 3 is a rear perspective view showing the keeping device in FIG. 1.

As shown in FIGS. 2 and 3, the frame 110 includes a rear wall portion 111 tightly attached to an inner wall surface of the refrigerating chamber door 5 and a plurality of side wall portions 112 formed to extend in a vertical direction from both horizontal ends of the rear wall portion 111.

Hinge recesses 114 are formed at an upper half portion of the both side wall portions 112 to allow hinge protrusions 131 of the moving shelf 130 (to be described) to be rotatably inserted therein, and guiding recesses 115 are formed near or around the hinge recesses 114 to allow the hinge protrusions 131 of the moving shelf 130 to be smoothly inserted therein. The guiding recesses 115 are formed to become deeper toward the hinge recesses 114.

First restraining protrusions 116 are formed at an upper side of the respective hinge recesses 115 in order to support second restraining protrusions 133 of the moving shelf 130 mounted thereon to maintain a second state, namely, a folded state, of the moving shelf 130 when the moving shelf 130 is folded so as not to receive a food item. Here, the first restraining protrusions 116 are formed to be positioned within a rotation locus of the second restraining protrusions 133.

The first restraining protrusions 116 may have a rectangular shape with a certain length along a forward and backward direction, namely, in a forward and backward widthwise direction of the side wall portions 112 to thereby stably support the second restraining protrusions 133. However, without being limited thereto, the first restraining protrusions 116 may have a circular shape. In this case, the second restraining protrusions 133 may have a rectangular shape.

Fixed support portions 117 are formed at corner portions where the rear wall portion 111 and the both side wall portions 112 meet in order to allow the moving shelf 130 to be supportedly mounted thereon when the moving shelf 130 is in a first state, namely, when the moving shelf 130 is unfolded to receive a food item. The fixed support portions 117 may be formed to extend from two surfaces so as to extend from the both corner portions, namely, from the rear wall portion 111 and the side wall portion 112 as mentioned above, in order to enhance strength of the fixed support portions 117. Alternatively, according to circumstances, the fixed support portions 117 may be formed to to extend only from the rear wall portion 111 or the side wall portion 112.

Preferably, the fixed support portions 117 are formed to extend in a direction perpendicular to the rear wall portion 111 and the side wall portion 112 so as to be easily separated from a mold pattern in molding the frame 110. Also, the fixed support portions 117 may be formed with a length shorter than the length in the forward/backward direction of the moving shelf 130, namely, the length of a rotation radius of the moving shelf 130, in order to shorten a collision length between the moving shelf 130 and the fixed support portions 117 to thus reduce collision noise.

A reinforcing support portion 118 may be formed between the fixed support portions 117 in order to support the moving shelf 130 when the moving shelf 130 is unfolded. As shown in FIG. 2, only one reinforcing support portion 118 may be formed at the middle of the rear wall portion 111, and a plurality of reinforcing support portions may be formed according to circumstances. Preferably, the reinforcing support portion 118 has a hemispheric shape to increase a support area, increase a support strength, and reduce an occupancy area.

A latch protrusion 119 is formed on a rear side surface of the rear wall portion 111 of the frame 110, namely, on the surface in contact with the inner side surface of the refrigerating chamber door 5, and inserted in a latch recess (not shown) provided on an inner side surface of the refrigerating chamber door 5 to support the frame 110. Accordingly, the side wall portions 112 of the frame 110 may be formed to have the same level or height so as not to cause a height difference in a widthwise direction.

Figure 4:
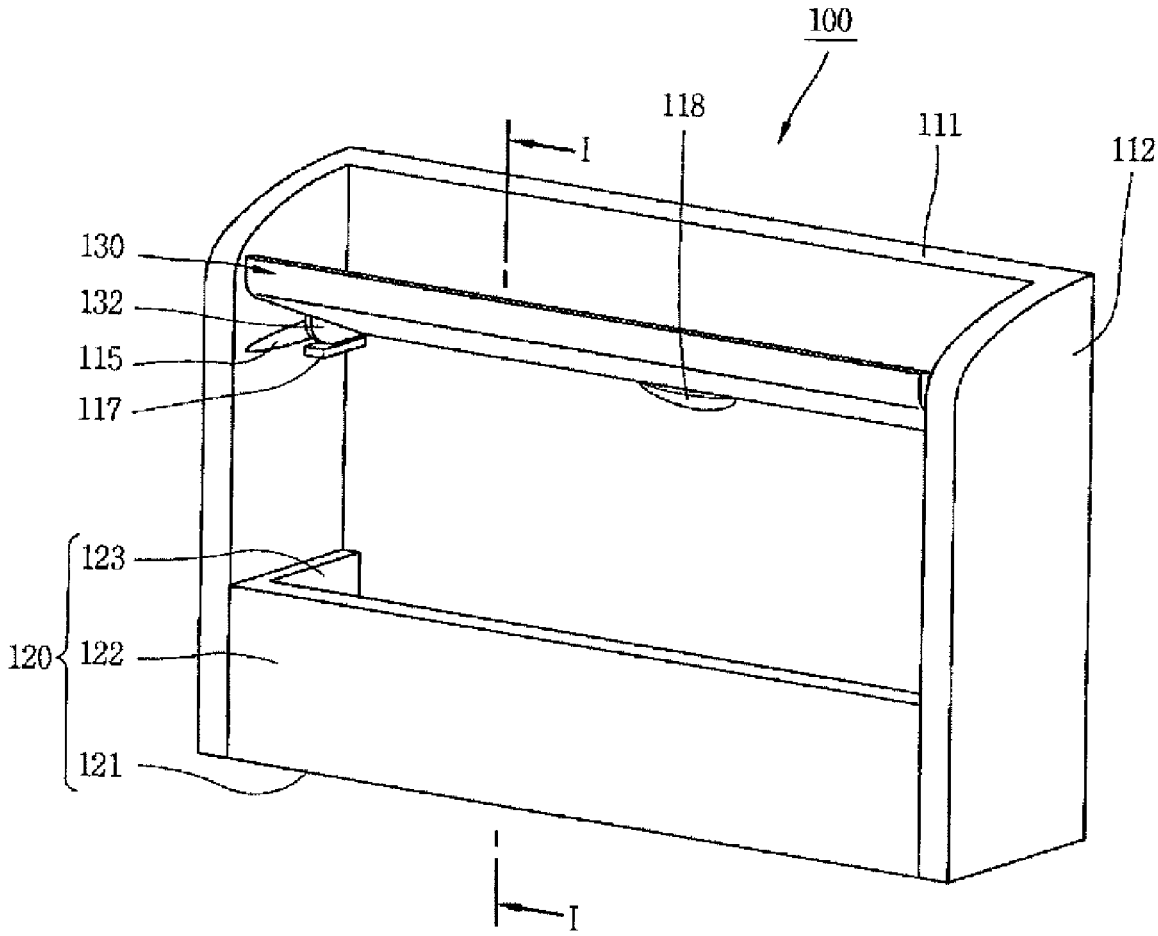
FIG. 4 is a front perspective view showing an unfolded state of the moving shelf in the keeping device in FIG. 1.
Figure 5:
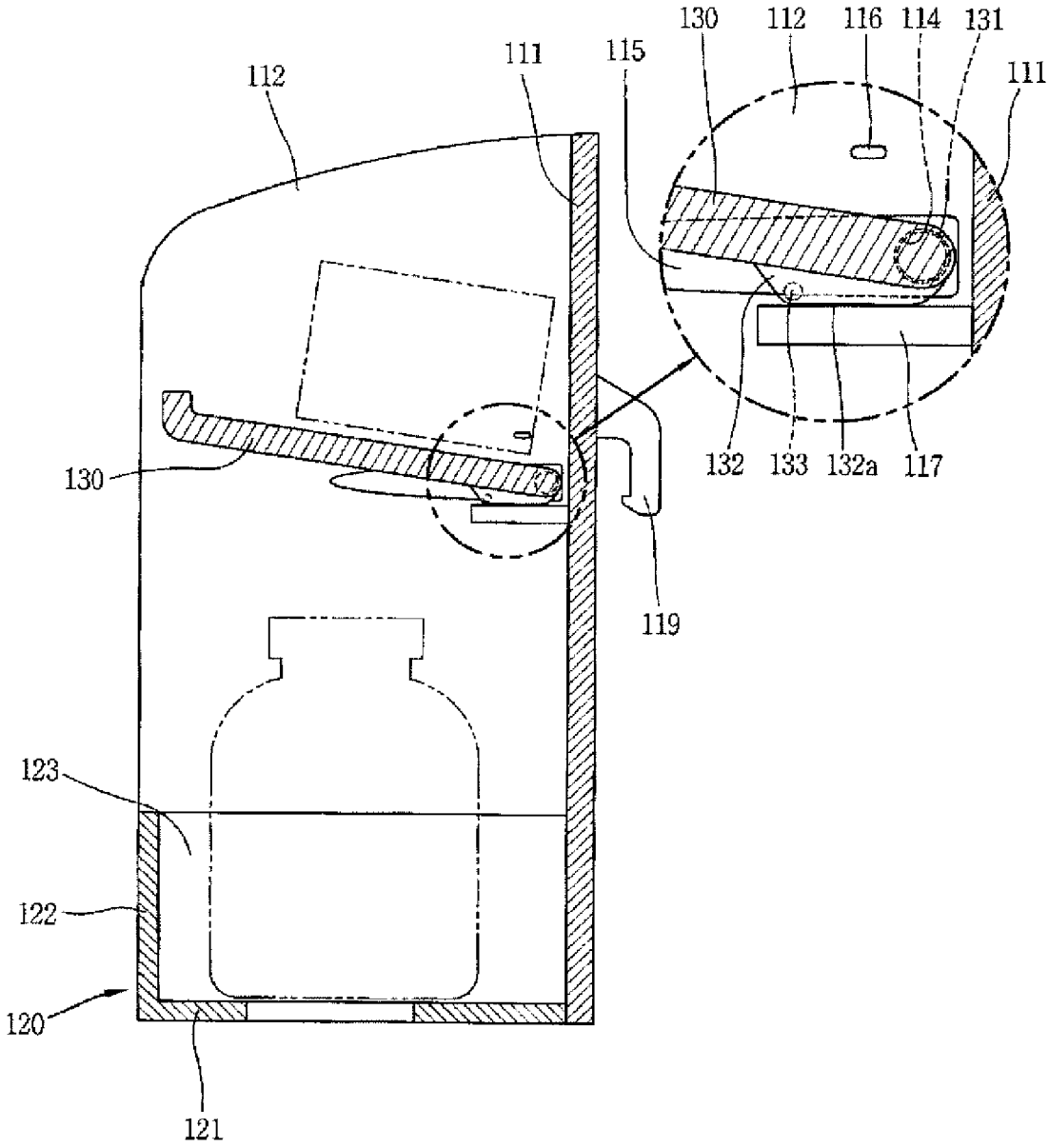
FIG. 5 is a sectional view taken along line I-I of FIG. 4.

As shown in FIGS. 4 and 5, the door basket 120 includes a bottom portion 121, a front portion 122 and both side wall portions 123 extending from the bottom portion 121 and the front portion 122. The front portion 122 may have such a height as to stably support a food item received in the door basket 120 so that the food item may not collapse forwardly. Namely, the front portion 122 may be as high as the width of the bottom portion 121. The both side portions 123 may be integrally molded on the inner side surface of the frame or may be post-assembled.

Figure 7:
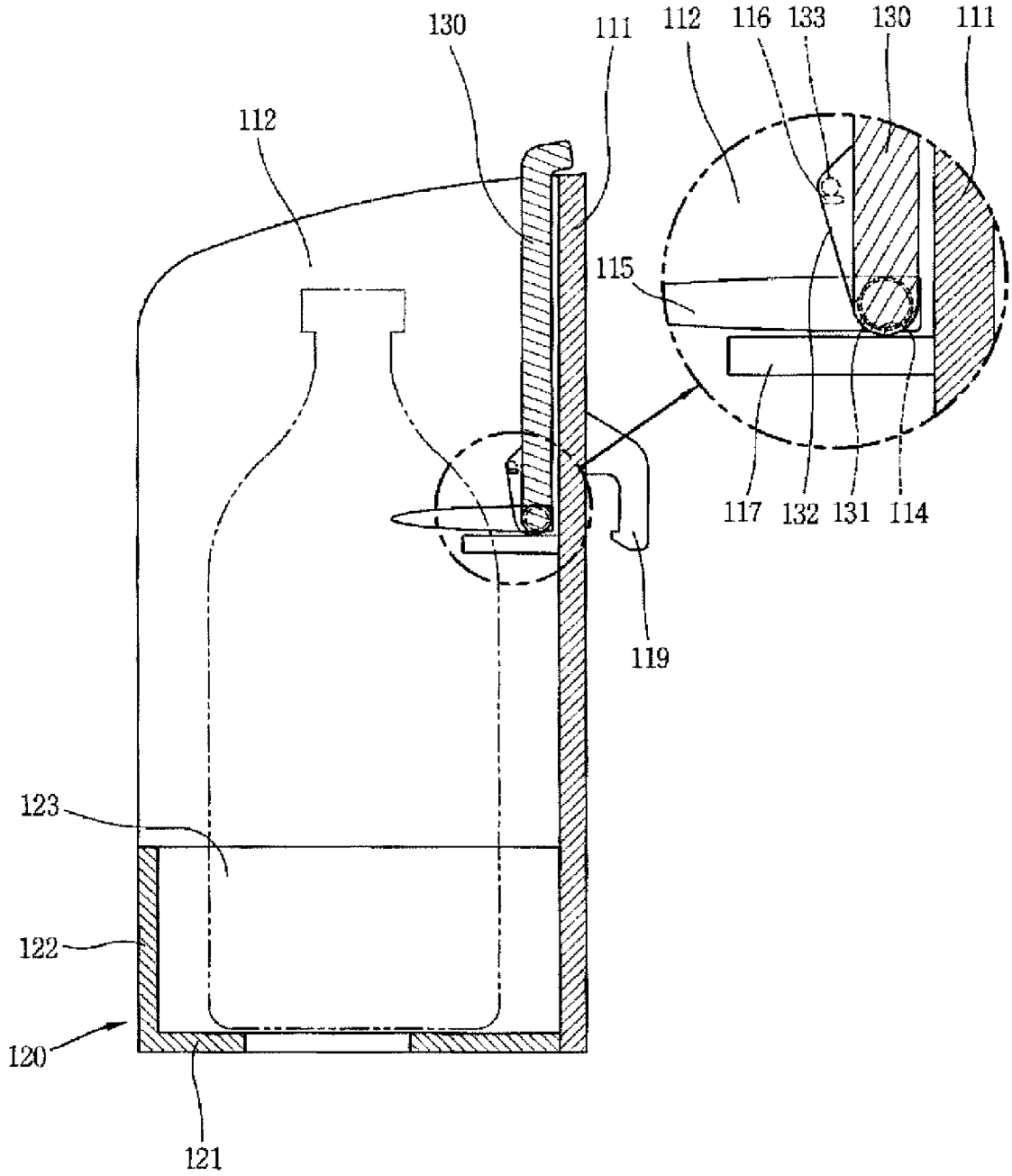
FIG. 7 is a sectional view taken along line II-II in FIG. 6.

As shown in FIGS. 2, 4, and 7, when the moving shelf 130 is folded, it has a flat plate shape only with the bottom portion, allowing an upper opening of the door basket 120 to be exposed. However, preferably, the moving shelf 130 is formed such that its front end is to be slightly bent upwardly, in order to stably support received food items.

As shown in FIG. 2, hinge protrusions 131 are formed at the end of the rear side of the moving shelf 130 and protruded by a certain length from both outer surfaces of the end of the inner side of the refrigerating chamber door 5.

Moving support portions 132 are formed to extend from lower surface of both ends of the rear side of the moving shelf 130 and supportedly mounted on the fixed support portions 117 of the frame 110. As shown in FIG. 5, the moving support portion 132 may include a slope face 132*a* so that a front end of the moving shelf 130 can be supported at a slightly higher position than the end of the rear side of the moving shelf 130 when the moving shelf 13 is unfolded. Of course, although not shown, the slope may be formed on an upper surface of the fixed support portion.

Here, the end of the hinge side of the moving support portion 132 or that of the moving shelf 130 may be formed to form a circle so as to be rollingly in contact with the upper surface of the fixed support portion 117, whereby when the moving shelf 130 is in the folded state, a restraining force can increase, and when the moving shelf 13 is the unfolded state, a rotational resistance can be generated to reduce noise. However, the end of the hinge side of the moving support portion 132 or that of the moving shelf 130 may be formed stepwise to form a plurality of circles to advantageously reduce the restraining force and noise.

Figure 6:
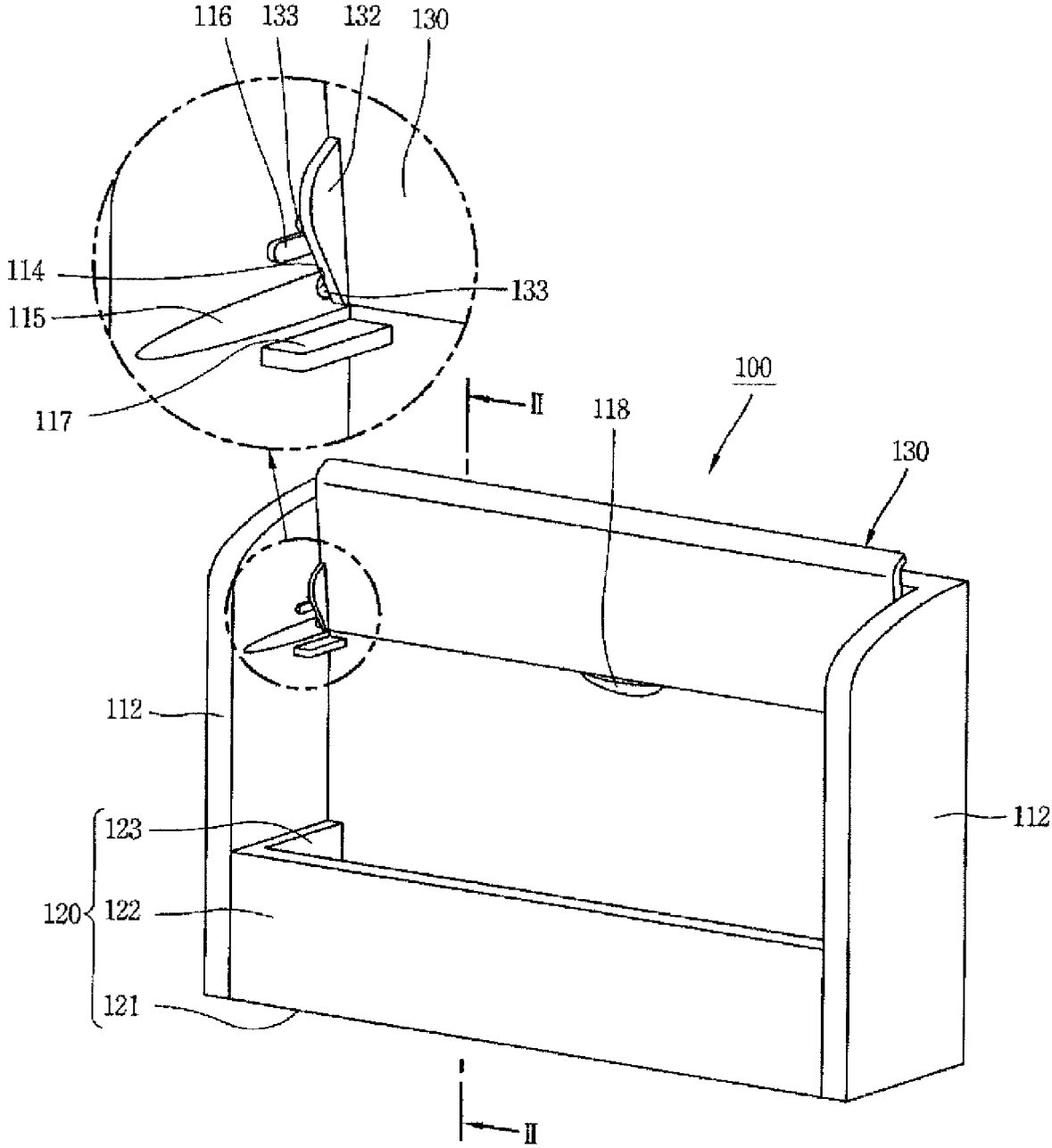
FIG. 6 is a front perspective view showing a folded state of the moving shelf in the keeping device in FIG. 1.

As shown in FIGS. 6 and 7, the second restraining protrusion 133 may be formed on an outer surface of the moving support portion 132 to allow the moving shelf 130 to be supportedly mounted on the first restraining protrusion 116 of the frame 110 when the moving shelf 130 is folded. Here, the moving support portion 132 is formed to be as thin as possible but within a range in which it has so sufficient rigidity as to support the moving shelf 130, in order to reduce a frictional contact between the first and second restraining protrusions 116 and 133. Namely, when the moving shelf 130 is folded or unfolded, the second restraining protrusion 133 passes over the first restraining protrusion 116, so frictional contact is generated between the both restraining protrusions 116 and 133. Thus, preferably, the moving support portion 132 has flexibility so that when the second restraining protrusion 133 passes over the first restraining protrusion 116, the moving support portion 132 can be elastically bent to reduce frictional contact between the both protrusions.

The second restraining protrusion 133 may have a rectangular shape with a certain length like the first restraining protrusion 116, and also may have a circular shape.

Only a single first restraining protrusion is illustrated, but without being limited thereto, according to circumstances, a plurality of first restraining protrusions may be formed along the locus of the first restraining protrusion 116 to reduce an unfolding speed when the moving shelf 130 is unfolded. In this case, preferably, the plurality of first restraining protrusions 116 may be formed to have different heights, namely, to become lower in the unfolding direction, in order to ensure smooth unfolding operation and folding operation.

The operational effect of the refrigerator according to an exemplary embodiment of the present invention is as follows.

Namely, when the user wants to put a lengthy drinking water bottle, a can, or the like, in the door basket 120, he can rotate the moving shelf 130 so as to be folded with the inner side surface of the refrigerating chamber door 5 to allow the upper opening of the door basket 120 to secure a sufficient space. In this case, as the moving shelf 130 is rotated centering around the hinge protrusions 131, the second restraining protrusions 133 provided at both sides of the moving shelf 130 pass over the first restraining protrusions 116 provided at both side wall portions 112 of the frame 110 so as to be mounted on the upper surface of the first restraining protrusions 116. Then, the second restraining protrusions 133 are mounted on the first restraining protrusions 116, restraining the moving shelf 130 from rotating in a reverse direction, namely, in the unfolding direction. Accordingly, the upper opening of the door basket 120 is exposed to secure a large space, and the user can easily put a lengthy food item such as a drinking water bottle or the like therein.

Meanwhile, when a food item with a low height is received in the door basket 120 of the refrigerating chamber door 5, the moving shelf 130 is rotated to be unfolded in a direction substantially perpendicular to the inner side surface of the refrigerating chamber door 5, increasing the receiving space. In this case, because the moving support portions 132 each having the slope face 132*a* are formed on the lower surface of the moving shelf 130, the slope faces 132 of the moving support portions 132 are mounted on the fixed support portions 117 of the frame 110. Accordingly, the moving shelf 130 can serve as a basket in a state that its front end is sloped to be slightly higher. The reinforcing support portion 118 is provided at the middle portion of the rear wall portion 111 of the frame 110 to support the moving shelf 130. Thus, the unfolded state of the moving shelf 130 can be more stably maintained.

Here, when the moving shelf 130 is changed from the unfolded state to the folded state or from the folded state to the unfolded state, the second restraining protrusions 133 are to pass over the first restraining protrusions 116. In this case, however, if the first restraining protrusions 116 and the second restraining protrusions 133 are formed to be too separated from each other, the moving shelf 130 could not be stably maintained in a folded state. Conversely, if the first restraining protrusions 116 and the second restraining protrusions 133 are formed to be too tightly attached, it would be difficult to rotate the moving shelf 130 to an unfolded state and the both restraining protrusions 116 and 133 would be slid in a mutually tightly attached state, having a possibility that they are abraded.

Figure 8:
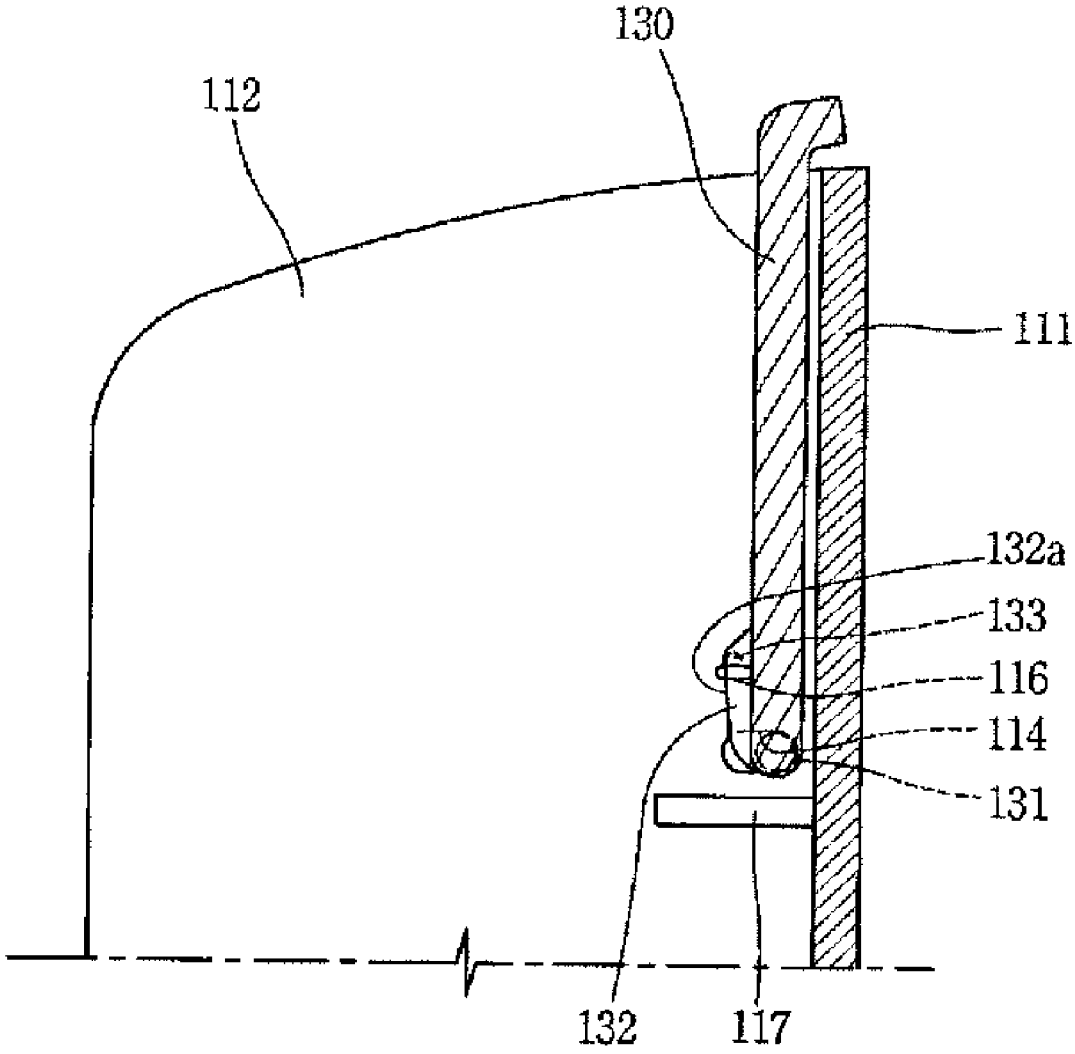
FIG. 8 is a side vertical sectional view for exampling a hinge recess of the keeping device in FIG. 1 according to an exemplary embodiment of the present invention.
Figure 9:
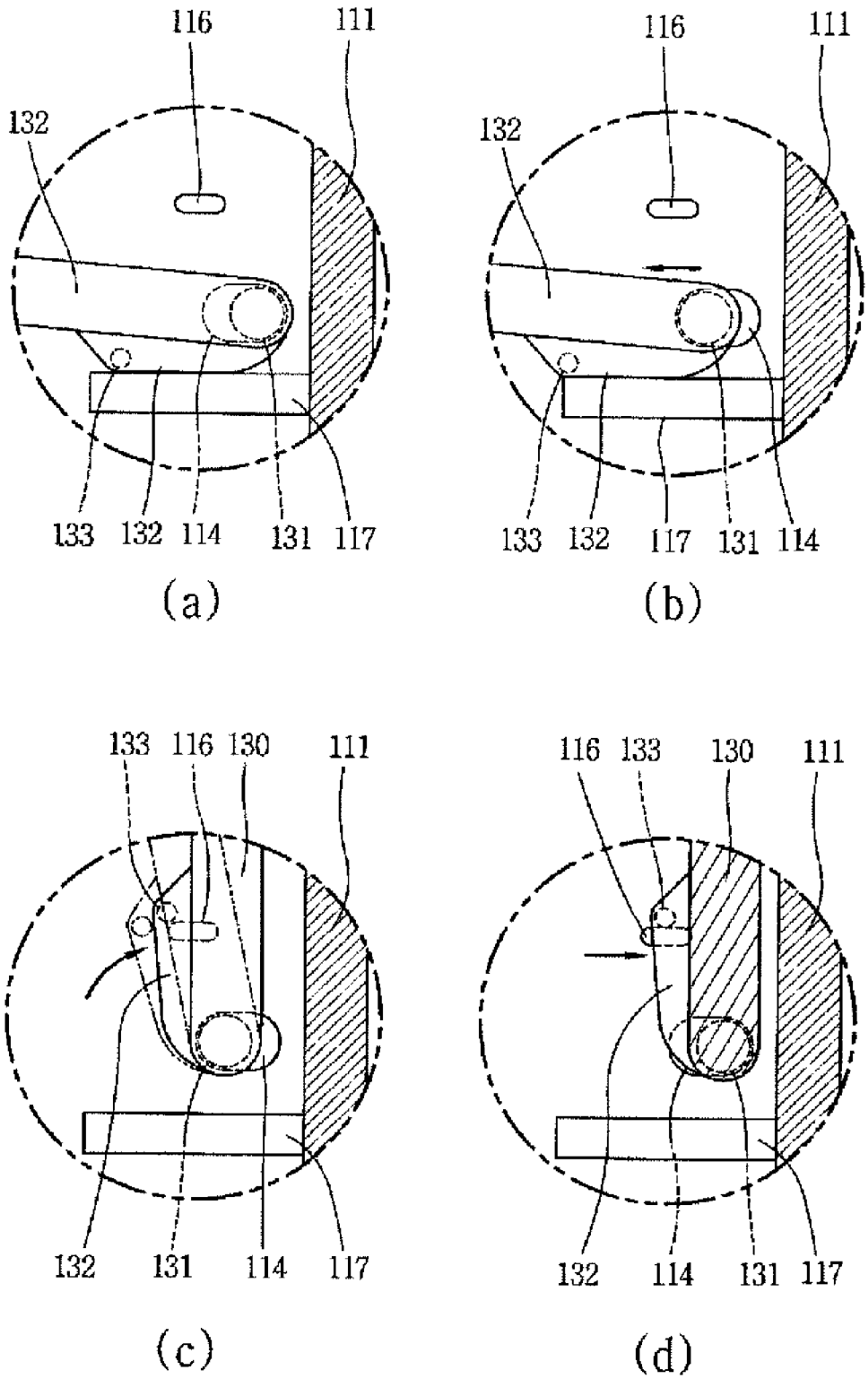
FIG. 9 is a side vertical sectional view showing the process of folding the moving shelf in the keeping device in FIG. 8.

Thus, as shown in FIG. 8, the hinge recesses 114 of the frame 110 are formed to be lengthy in the widthwise direction, namely, in the forward/backward direction, of the side wall portions 112 to vary the rotation radius of the moving shelf 130 to prevent abrasion between the both restraining protrusions 116 and 113. Namely, as shown in FIGS. 9(*a*) and 9(*b*), when the moving shelf 130 is rotated, it is pulled forwardly, namely, to the user side. Then, the hinge protrusions 131 are slid forwardly in the hinge recesses 114 and the rotational center of the moving shelf 130 is moved to the front side.

When the moving shelf 130 is rotated as shown in FIG. 9(*c*), the second restraining protrusions 133 are mounted on the upper surface of the first restraining protrusions 116 in a state that the first restraining protrusions 116 and the second restraining protrusions 133 are not in contact with each other.

When the rotation of the moving shelf 130 is completed as shown in FIG. 9(*d*), the moving shelf 130 is pushed toward the rear wall portion 111 of the frame 110 to fix it.

Accordingly, the first restraining protrusions 116 and the second restraining protrusions 133 can be formed with a stable height, less force is required to rotate the moving shelf 130, and less frictional contact may be made between the both restraining protrusions 116 and 133.

Thus, the space between door baskets can be adjusted by folding or unfolding the moving shelf depending on the height of food items to be received in the door baskets. Namely, when a lengthy food item is to be received in the door basket, a moving shelf positioned at a middle portion may be folded to increase the space between the door baskets to thus stably put in the lengthy food item. If there is no need to put in a lengthy food item, the folded door basket may be unfolded to increase the number of door baskets to accommodate more small food items.

Also, because the a certain space is secured between the door basket and the moving shelf, even in a state that food items are received in the moving shelf, food items can be easily received in the door basket or food items received in the door basket can be easily taken out.

When the moving shelf is unfolded, the moving shelf is lightly to be in contact with the surface supporting the moving shelf to generate collision noise. However, in the present exemplary embodiment, the length of the fixed support portions and the moving support portions provided at the frame and at the moving shelf is shorter than the length of the moving shelf in the forward/backward direction, so the collision noise generated when the moving shelf is unfolded can be reduced.

Also, because the restraining protrusions are formed at the frame and at the moving shelf and mutually supported to maintain the folded state of the moving shelf, the structure for maintaining the folded state of the moving shelf can be simplified and thus the fabrication cost can be reduced.

In addition, because the keeping device is insertedly fixed at the refrigerating chamber door, an effective space of the keeping device can be extended.

A refrigerator according to another exemplary embodiment of the present invention will now be described.

Figure 10:
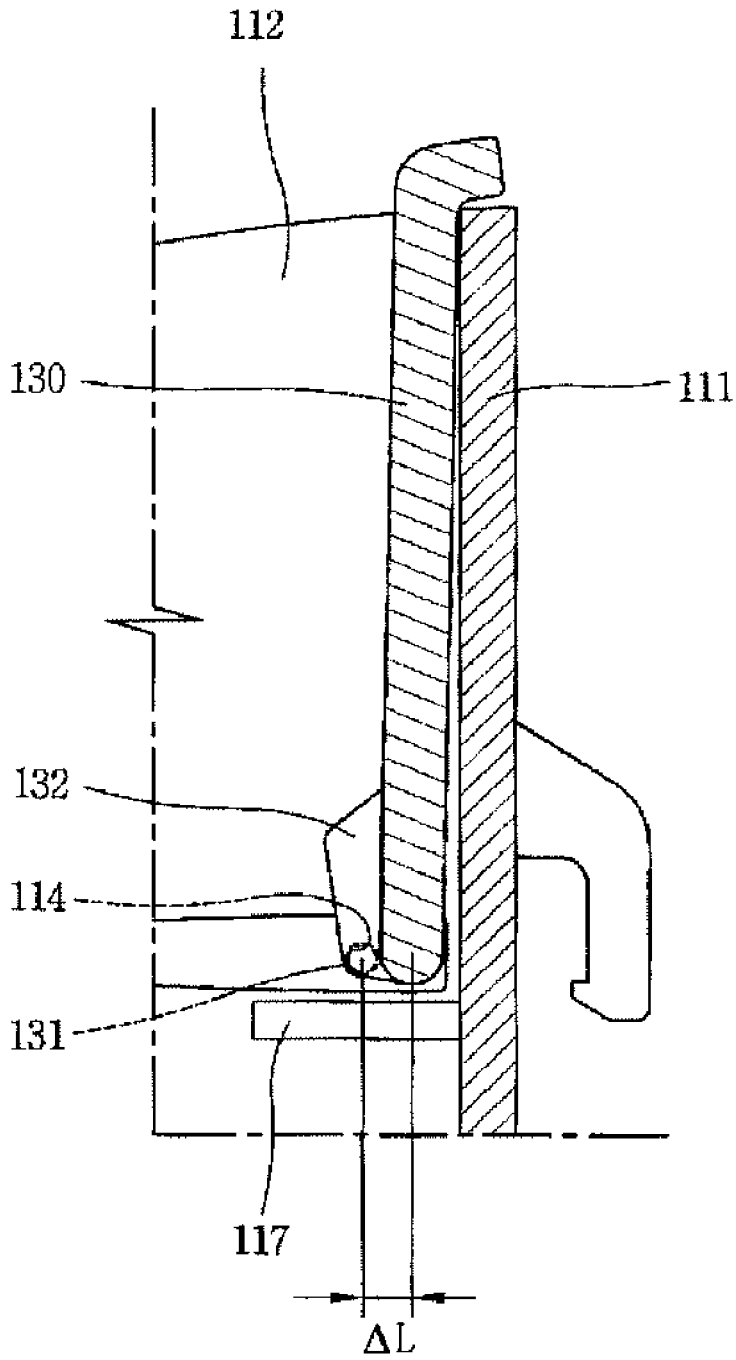
FIG. 10 is a side vertical sectional view showing the configuration for restraining the moving shelf in FIG. 1.

In the former exemplary embodiment as described above, when the moving shelf 130 is folded, the restraining protrusions 116 and 133 provided to the frame 110 and to the moving shelf 130 are mutually supported to maintain the folded state of the moving shelf 130. Comparatively, in the present exemplary embodiment, as shown in FIG. 10, a rotation center and the center of gravity of the moving shelf 130 are separated by a certain space (ΔL) so that the rotation center and the center of gravity of the moving shelf 130 cannot be positioned at the same line, thereby maintaining the moving shelf 130 in the folded state without using a restraining protrusion.

To this end, a hinge point of the moving shelf 130 is formed to be positioned at an outer side than the center of the moving shelf 130 in a lengthwise direction, namely, at the side away from an inner side surface of the refrigerating chamber door 5. Accordingly, when the moving shelf 130 is rotated in the folded state, the end of the moving shelf 130 proceeds further than a vertical central line of the hinge protrusions 131, and thus, the center of gravity of the moving shelf 130 can be positioned at an inner side than the rotation center, allowing the moving shelf 130 to be maintained in a folded state. Of course, also in this case, the presence of the restraining protrusions 116 and 133 ensures the increase in the restraining force of the moving shelf 130. Also, in this case, although the tightly attachment force between the restraining protrusions 116 and 133 is slightly reduced, because the center of gravity and the rotation center of the moving shelf are separated, the moving shelf 130 can be more stably maintained.

A refrigerator according to still another exemplary embodiment of the present invention will now be described.

Figure 11:
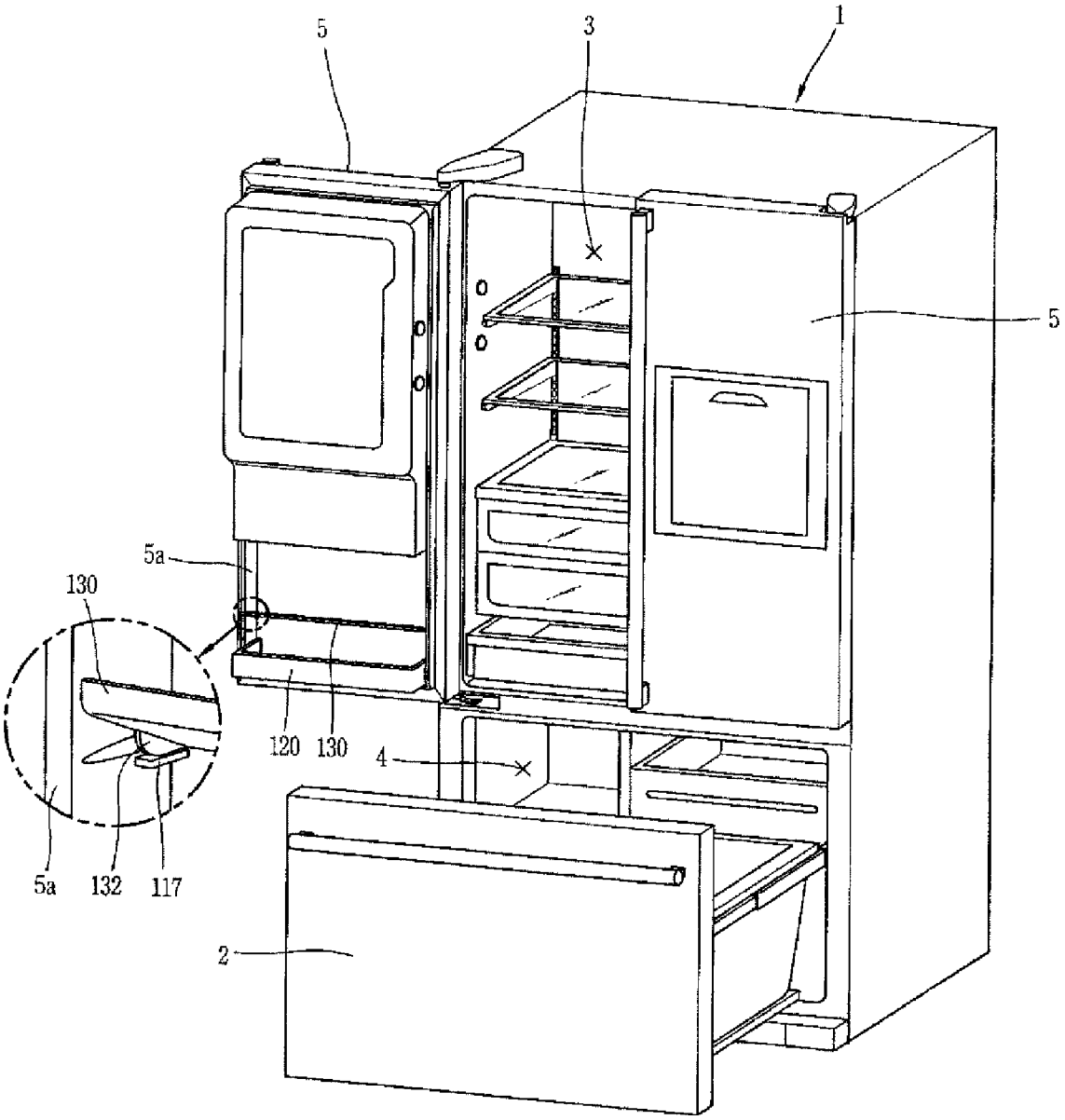
FIG. 11 is a perspective view showing a bottom freezer type refrigerator for explaining a keeping device of FIG. 1 installed in a refrigerator door according to an exemplary embodiment of the present invention.

In the former exemplary embodiments as described above, the door basket 120 and the moving shelf 130 are coupled to the frame 110, and the frame 110 is coupled to the refrigerating chamber door 5. Comparatively, in the present exemplary embodiment, as shown in FIG. 11, the door basket 120 and the moving shelf 130 are independently directly coupled to the side wall face 5*a* of the refrigerating chamber door 5, in a state that the frame 110 as in FIG. 11 is excluded.

Also, in this case, the door basket 120 is coupled to be fixed to the refrigerating chamber door 5, while the moving shelf 130 is rotatably coupled to the refrigerating chamber door 5. The basic configuration of coupling the door basket 120 and the moving shelf 130 to the refrigerating chamber door 5 and its operational effect are the same as those in the above-described embodiments, so its detailed description will be omitted. It is noted that, in the present exemplary embodiment, the fixed support portions, the reinforcing support portions, and the first restraining protrusions may be directly formed on the inner wall surface of the refrigerating chamber door.

The refrigerator having the keeping device according to the present exemplary embodiment has the same operational effect as that of the above-described exemplary embodiments. In addition, because the refrigerator does not have the frame, the number of components and corresponding assembling process are reduced to further reduce the fabrication cost.

As for the keeping device of the refrigerator and the refrigerating having the same according to the exemplary embodiments of the present invention as described above, the keeping device is installed at the refrigerating chamber door, but it can be also applicable to the freezing chamber door in the same manner according to types of refrigerators. Also, in the present exemplary embodiment, the 3-bottom freezer type refrigerator is illustrated, but the present invention can be applicable to any refrigerator having a keeping device in the same manner.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a door for opening and closing a freezing chamber or a refrigerating chamber;

a door basket supported by an inner side surface of the door;

a moving shelf that is positioned at an upper side of the door basket, that is supported by the inner side surface of the door, and that is rotatable relative to the inner side surface of the door;

a support unit configured to maintain the moving shelf in a first state that allows the moving shelf to receive a food item; and a restraining unit configured to maintain the moving shelf in a second state in which the moving shelf does not support the food item, wherein the support unit comprises a fixed support portion that protrudes from a side wall portion that extends away from the inner side surface of the door and that has a length shorter than a length of the moving shelf, and a moving support portion positioned on a lower surface of the moving shelf and configured to be supported by the fixed support portion, and wherein an upper surface of the fixed support portion that supports the moving support portion has a horizontal flat surface, and the moving support portion has a curved surface that enables the moving support portion to roll against the horizontal flat surface of the fixed support portion during rotation of the moving shelf between the first and second states.

2. The refrigerator of claim 1, wherein the moving support portion further comprises a straight surface extended from the curved surface, and wherein the straight surface of the moving support portion is sloped with respect to the horizontal flat surface of the fixed support portion.

3. The refrigerator of claim 1, wherein the door comprises one or more reinforcing support portions to support the moving shelf.

4. The refrigerator of claim 1, wherein the restraining unit comprises:

at least one first protrusion fixed to the door; and a second protrusion formed on at least one of both side surfaces of the moving shelf so as to allow the first protrusion to be supported thereon.

5. The refrigerator of claim 4, wherein the second protrusion is formed at the moving support portions, respectively.

6. The refrigerator of claim 4, wherein at least one of the first and second protrusions has a rectangular shape.

7. The refrigerator of claim 6, wherein the first protrusion is positioned at a rotation locus of the second protrusion.

8. The refrigerator of claim 6, wherein a hinge protrusion and a hinge recess are formed between the door and the moving shelf in order to allow the moving shelf to rotate, and the hinge recess is formed as a long recess-like shape to allow the moving shelf to move in a rotational radius direction.

9. The refrigerator of claim 1, wherein a rotational center and the center of gravity of the moving shelf have a certain interval on a plane so that the restraining unit is restraining by the difference between the rotational center and the center of gravity.

10. A keeping device for a refrigerator, the keeping device comprising:

a frame detachably coupled to a door for opening and closing a freezing chamber or a refrigerating chamber;

a door basket coupled to the frame;

a moving shelf positioned at an upper side of the door basket and rotatably coupled to the frame;

a support unit configured to maintain the moving shelf in a first state in which the moving shelf receives a food item; and a restraining unit configured to maintain the moving shelf in a state in which the moving shelf does not support a food item, wherein the support unit includes a fixed support portion that protrudes from a side wall portion of the frame and that has a length shorter than a length of the moving shelf, and a moving support portion positioned on a lower surface of the moving shelf and configured to be supported by the fixed support portion, and wherein an upper surface of the fixed support portion that supports the moving support portion has a horizontal flat surface, and the moving support portion has a curved surface that enables the moving support portion to roll against the horizontal flat surface of the fixed support portion during rotation of the moving shelf between the first and second states.

11. The keeping device of claim 10, wherein the moving support portion further comprises a straight surface extended from the curved surface, and wherein the straight surface of the moving support portion is sloped with respect to the horizontal flat surface of the fixed support portion.

12. The keeping device of claim 10, wherein the frame comprises one or more reinforcing support portions to support the moving shelf.

13. The keeping device of claim 10, wherein the restraining unit comprises:

at least one first protrusion fixed to the frame; and a second protrusion formed on at least one of both side surfaces of the moving shelf so as to allow the first protrusion to be supported thereon.

14. The keeping device of claim 13, wherein the second protrusion is formed at the moving support portions, respectively.

15. The keeping device of claim 13, wherein the first protrusion is positioned at a rotation locus of the second protrusion.

16. The keeping device of claim 13, wherein a hinge protrusion and a hinge recess are formed between the door and the moving shelf in order to allow the moving shelf to rotate, and the hinge recess is formed as a long recess-like shape to allow the moving shelf to move in a rotational radius direction.

* * * * *